US011208923B2

(12) United States Patent
Ahmed et al.

(10) Patent No.: US 11,208,923 B2
(45) Date of Patent: Dec. 28, 2021

(54) TAPPET

(71) Applicant: Schaeffler Technologies AG & Co. KG, Herzogenaurach (DE)

(72) Inventors: Faheem Ahmed, Rochester Hills, MI (US); Peter Sailer, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/197,505

(22) Filed: Mar. 10, 2021

(65) Prior Publication Data

US 2021/0310381 A1 Oct. 7, 2021

Related U.S. Application Data

(60) Provisional application No. 63/006,689, filed on Apr. 7, 2020.

(51) Int. Cl.
*F01L 1/245* (2006.01)
*F01L 1/24* (2006.01)

(52) U.S. Cl.
CPC ..... *F01L 1/245* (2013.01); *F01L 2001/2427* (2013.01); *F01L 2001/256* (2013.01)

(58) Field of Classification Search
CPC ..... F01L 2001/2427; F01L 1/245; F01L 2001/256
USPC ..... 123/90.55
See application file for complete search history.

(56) References Cited

U.S. PATENT DOCUMENTS 2,688,317 A * 9/1954 Voorhies ..... F01L 1/2422 123/90.55
2,874,684 A * 2/1959 Thompson ..... F01L 1/245 123/90.55
5,680,838 A * 10/1997 See ..... F01L 1/2411 123/90.46
5,706,771 A * 1/1998 Van Heyningen .... F01L 1/2411 123/90.46
7,823,555 B2 11/2010 Bugescu et al.
2006/0090720 A1* 5/2006 Spath ..... F01L 13/0005 123/90.48
2017/0234173 A1* 8/2017 Nielsen ..... F01L 1/24 123/90.55

FOREIGN PATENT DOCUMENTS

EP 3212903 B1 11/2019
WO 2015067252 A1 5/2015
WO 2015067253 A1 5/2015

* cited by examiner

*Primary Examiner* — Jorge L Leon, Jr.

(57) ABSTRACT

A hydraulic tappet configured for a valve train of an internal combustion engine is provided. The tappet includes an outer housing, a socket plunger, and a hydraulic lash adjuster assembly. The socket plunger and the hydraulic lash adjuster assembly are disposed within the outer housing. The hydraulic lash adjuster assembly includes an outer casing, a piston, and a check valve assembly. The outer casing is configured with a spherical first end. The hydraulic lash adjuster assembly can include a swivel pad that engages the spherical first end. The piston is at least partially received by an opening in the outer casing. The piston and socket plunger define a first fluid chamber, while the piston and outer casing define a second fluid chamber. The check valve assembly is arranged to fluidly connect the first fluid chamber to the second fluid chamber.

18 Claims, 6 Drawing Sheets

TAPPET

CROSS-REFERENCE TO RELATED APPLICATIONS

This application claims the benefit under 35 U.S.C. § 119(e) of U.S. Provisional Application No. 63/006,689 filed on Apr. 7, 2020, which application is incorporated herein by reference.

TECHNICAL FIELD

Example aspects described herein relate to a tappet for a high pressure fuel pump or a valve train of an internal combustion (IC) engine.

BACKGROUND

A valve train of an IC engine translates rotary cam motion to linear motion of a poppet valve to enable a gas exchange process for a 2-stroke or 4-stroke cycle. A tappet can be utilized to operatively connect a camshaft to the poppet valve. A high pressure fuel pump of an IC engine provides pressurized fuel to fuel injectors to enable fueling of an engine cylinder during a 2-stroke or 4-stroke cycle. A tappet can be utilized to operatively connect a camshaft to the high pressure fuel pump.

SUMMARY

An example embodiment of a tappet is provided for an IC engine that includes an outer housing, a socket plunger, and a hydraulic lash adjuster (HLA) assembly. The outer housing can be longitudinally displaced by a camshaft to a first height equal to a cam lift of the camshaft. The outer housing can have a roller configured to directly engage the camshaft. The socket plunger and HLA assembly are disposed within a longitudinal bore of the outer housing and the socket plunger is engaged with the HLA assembly. The HLA assembly includes an outer casing with a spherical first end, a piston disposed at least partially within a second end of the outer casing, and a check valve assembly. The spherical first end can engage a concave receiving land arranged at a bottom of the first longitudinal bore. The piston and socket plunger define a first fluid chamber, and the piston and outer casing define a second fluid chamber. The check valve assembly is arranged to fluidly connect the first fluid chamber to the second fluid chamber and can be configured in a biased open or biased closed position. The socket plunger can fluidly connect the first fluid chamber to a concave landing arranged on the socket plunger. The socket plunger can include both an axially extending passage and a transverse passage.

In an example embodiment, the hydraulic lash adjuster assembly includes a swivel pad. The swivel pad has a first side that engages the spherical first end of the outer casing to form a spherical joint, and a second side that engages a bottom end of the first longitudinal bore of the outer housing.

In an example embodiment, the outer casing, piston, and socket plunger define a third fluid chamber that is fluidly connected to the first fluid chamber. At least one radial port of the outer housing is configured to connect a hydraulic fluid pressure source to the third fluid chamber.

In an example embodiment, the outer casing is arranged at a first longitudinal height within the first longitudinal bore and the first longitudinal height is maintained throughout a valve lift event. The piston extends from a second end of the outer casing and is configured to be movable to adjust a lash in a valve train system. The socket plunger can be configured to engage a pushrod to actuate a rocker arm of the IC engine.

In an example embodiment, the tappet includes a central axis and a first portion of the HLA assembly is configured to tilt and rotate relative to a remaining portion of the HLA assembly. The first portion is configured to tilt to an angle of at least 3 degrees relative to the remaining portion. In another example embodiment, the first portion is configured to tilt to an angle of at least 5 degrees relative to the remaining portion.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
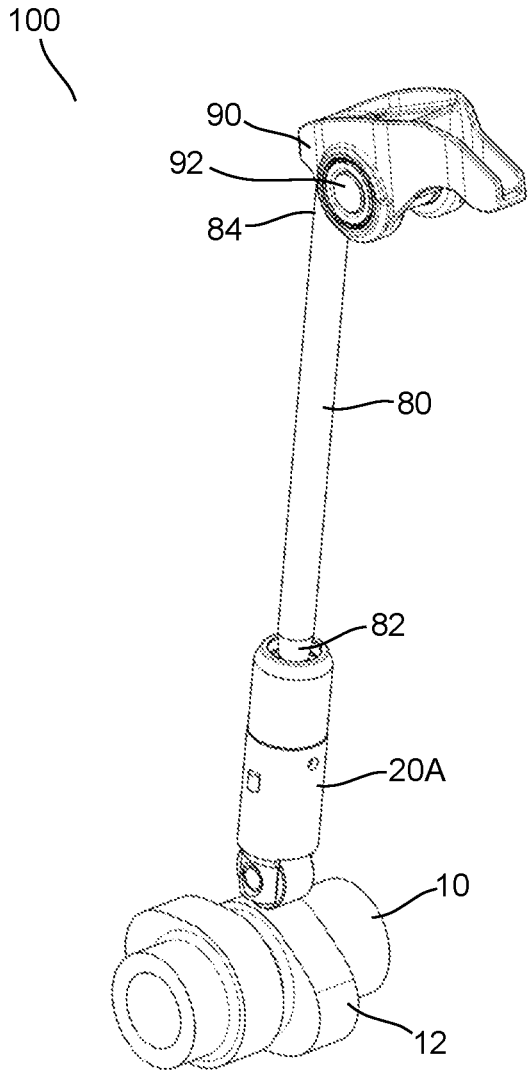
FIG. 1 shows a perspective view of a valve train system that includes an example embodiment of a hydraulic tappet.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Figure 12A:
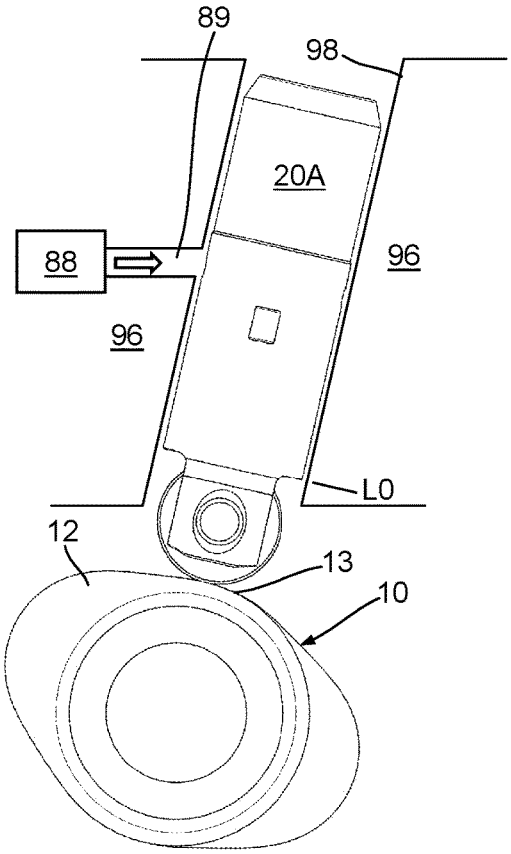
FIG. 12A shows a front view of the hydraulic tappet and camshaft of FIG. 1 with the hydraulic tappet engaged with a base circle of the camshaft.
Figure 12B:
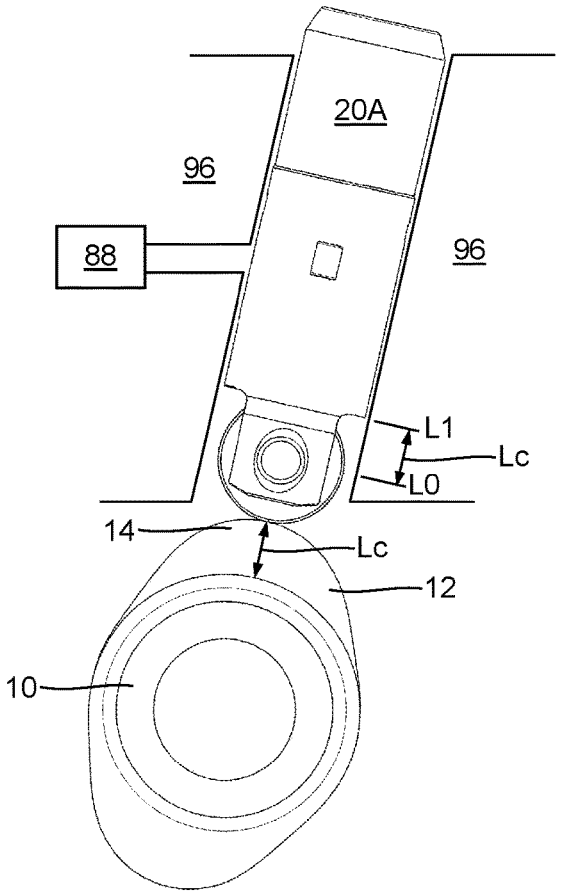
FIG. 12B shows a front view of the hydraulic tappet and camshaft of FIG. 1 with the hydraulic tappet at a peak lift position.

FIG. 1 shows a perspective view of a valve train system 100 for an internal combustion (IC) engine, which includes a portion of a camshaft 10, an example embodiment of a hydraulic tappet 20A, a pushrod 80, and a rocker arm 90. FIGS. 12A and 12B show a front view of the camshaft 10 and hydraulic tappet 20A of FIG. 1, with the tappet disposed within an engine bore 98 of the IC engine 96 such that rotary motion of a lobe 12 of the camshaft 10 is translated to linear motion of the hydraulic tappet 20A within the engine bore 98. The hydraulic tappet 20A engages a lower end 82 of the pushrod 80 while an upper end 84 of the pushrod engages the rocker arm 90. Thus, linear motion of the hydraulic tappet 20A moves the rocker arm 90 about a pivot 92 via the pushrod 80 to actuate an engine poppet valve (not shown). FIG. 12A shows the hydraulic tappet 20A engaged with base circle 13 of the camshaft 10, defining a base position L0 of the hydraulic tappet 20A within the engine bore 98; and, FIG. 12B shows the hydraulic tappet 20A engaged with the lobe 12, particularly a peak lift portion 14 of the lobe 12 such that the hydraulic tappet 20A is displaced within the engine bore 98 by the lobe 12 to a position L1. The maximum displacement of the hydraulic tappet 20A is defined by the linear distance between L0 and L1, which is equal to a maximum cam lift Lc of the lobe 12.

Figure 2:
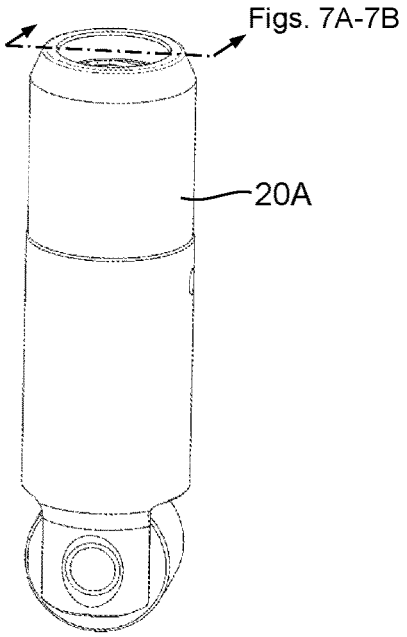
FIG. 2 shows a perspective of the hydraulic tappet of FIG. 1.
Figure 3:
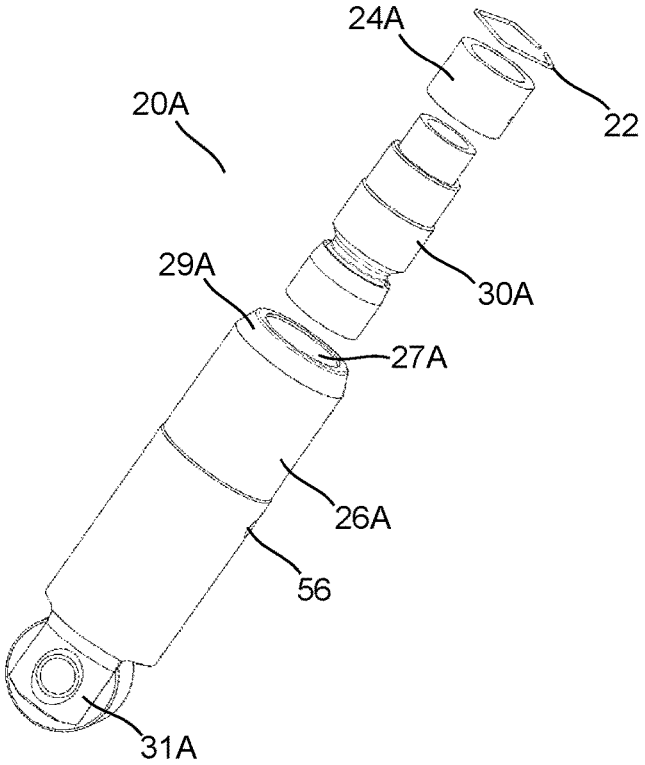
FIG. 3 shows an exploded perspective view of the hydraulic tappet of FIGS. 1 and 2 that includes an example embodiment of a hydraulic lash adjuster (HLA) assembly.
Figure 4:
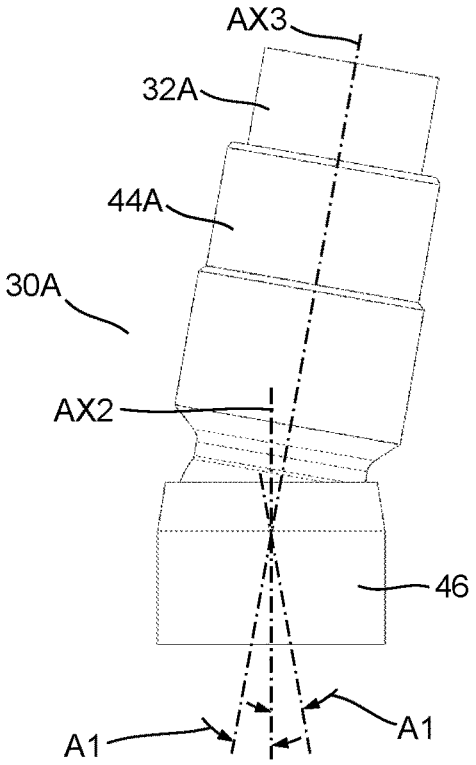
FIG. 4 shows a front view of the HLA assembly of FIG. 3.
Figure 6A:
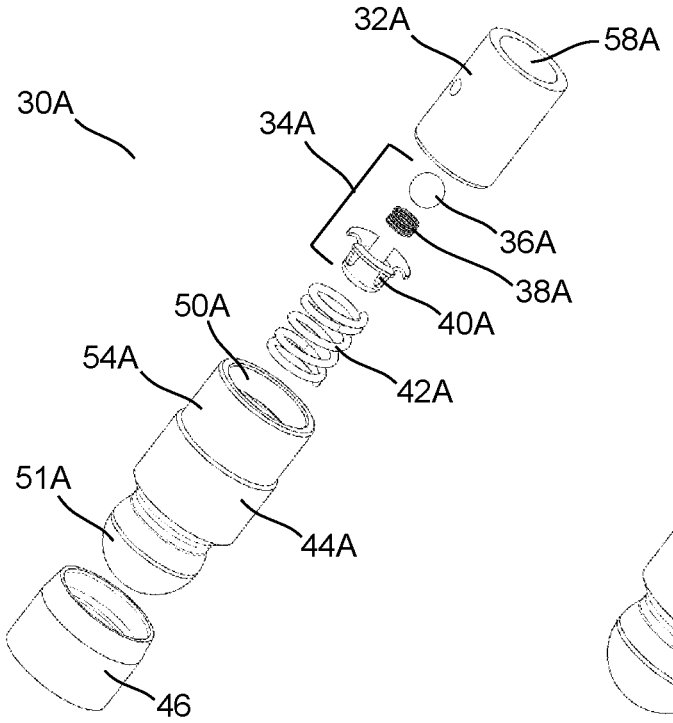
FIG. 6A shows an exploded perspective view of the HLA assembly of FIGS. 3 and 4.
Figure 7A:
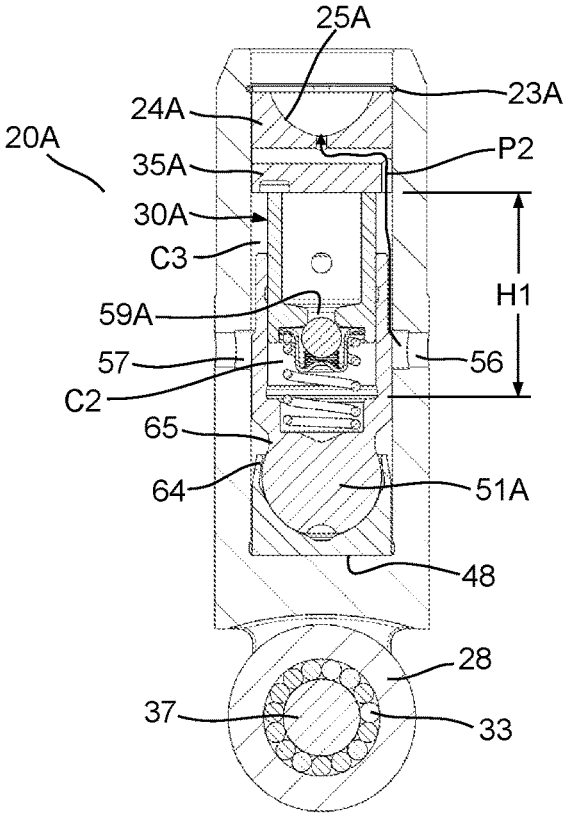
FIG. 7A shows a cross-sectional view taken from FIG. 2 with the HLA assembly in a first hydraulic position.
Figure 7B:
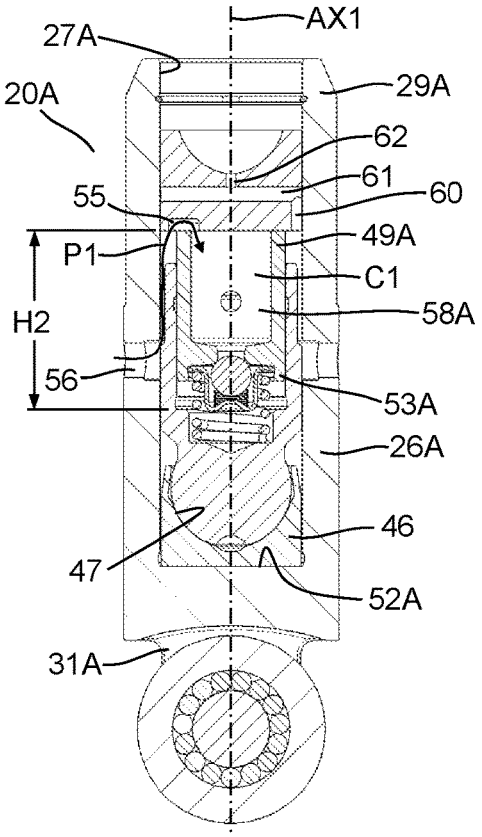
FIG. 7B shows a cross-sectional view taken from FIG. 2 with the HLA assembly in a second hydraulic position.
Figure 10A:
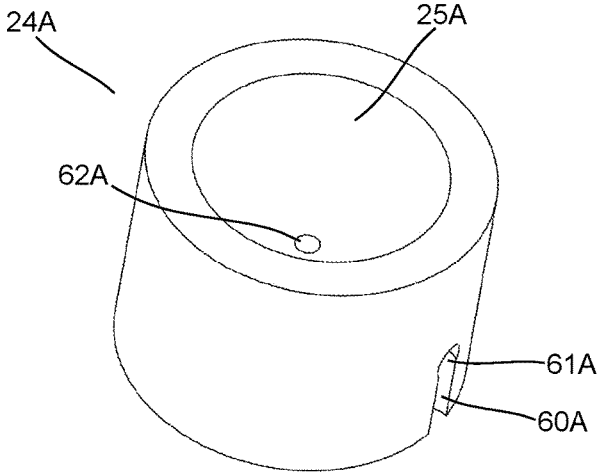
FIGS. 10A and 10B show perspective views of an example embodiment of a socket plunger.
Figure 10B:
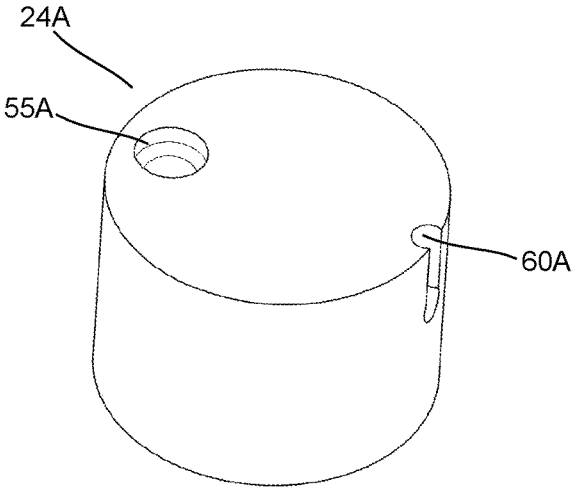

FIG. 2 shows a perspective view of the hydraulic tappet 20A. FIG. 3 shows an exploded isometric view of the hydraulic tappet 20A that includes a hydraulic lash adjuster assembly 30A. FIG. 4 shows the hydraulic lash adjuster (HLA) assembly 30A in a tilted position. FIG. 6A shows an exploded isometric view of the HLA assembly 30A. FIG. 7A shows a cross-sectional view taken from FIG. 2 with the HLA assembly 30A in a first hydraulic position that defines a first HLA height H1. FIG. 7B shows a cross-sectional view taken from FIG. 2 with the HLA assembly 30A in a second hydraulic position that defines a second HLA height H2. FIGS. 10A and 10B show perspective views of an example embodiment of a socket plunger 24A. The following discussion should be read in light of FIGS. 2-4, 6A, 7B, and 11A-11B.

The hydraulic tappet 20A includes an outer housing 26A with a longitudinal bore 27A to receive the HLA assembly 30A and a socket plunger 24A. The longitudinal bore 27A includes an annular groove 23A that receives a retaining clip 22 which retains both the HLA assembly 30A and the socket plunger 24A within the longitudinal bore 27A. The outer housing 26A includes a first end 29A that is open via the longitudinal bore 27A, a second end 31A that houses a roller 28, and radial ports 56 that facilitate delivery of hydraulic fluid to the HLA assembly 30A. A receiving land 25A of the socket plunger 24A directly engages the lower end 82 of the pushrod 80. The receiving land 25A can be formed as a concave gothic arch to optimize its contact interface with the lower end 82 of the pushrod 80 which is typically spherically formed. The roller 28 is mounted to the second end 31A of the outer housing 26A via an axle 37 and rolling elements 33 to provide a rolling interface with the camshaft 10. It could also be possible to eliminate the rolling elements 33 so that the roller 28 interfaces directly with the axle 37. Furthermore, it could also be possible to eliminate the roller 28 and implement a non-rolling interface with the camshaft 10.

The HLA assembly 30A, as shown in FIGS. 6A and 7A-7B, includes a piston 32A, an outer casing 44A, a return spring 42A, a check valve assembly 34A, and a swivel pad 46. A first or upper end 49A of the piston 32A is engaged by a lower end 35A of the socket plunger 24A. The outer casing 44A includes a bore 50A that receives the piston 32A, a ball or spherical end 51A, and a reduced diameter portion 54A. The spherical end 51A engages a socket reception landing 47 of the swivel pad 46; and, the swivel pad 46 includes a pad surface 48 to engage a bottom 52A of the longitudinal bore 27A of the outer housing 26A. The pad surface 48 can be crowned, flat, or any suitable shape to contact the bottom 52A of the longitudinal bore 27A. The ball or spherical end 51A and socket reception landing 47 form a ball-and-socket joint, also known as a spheroidal joint that allows the swivel pad 46 to rotate 360 degrees and tilt relative to the spherical end 51A. As shown in FIG. 4, a central axis AX2 of the swivel pad 46 can tilt to an angle A1 relative to a central axis AX3 of the outer casing 44A. The tilt angle A1 of FIG. 4 is approximately 10 degrees, however, the tilt angle A1 can vary anywhere from zero degrees up to a limit determined by a physical stop formed between a rim 64 of the swivel pad 46 and a base 65 of the spherical end 51A; and, the swivel pad 46 can tilt in either direction, clockwise or counterclockwise from the 2D perspective of FIG. 4, relative to the spherical end 51A. Furthermore, the tilt angle A1 can be achieved at any rotational angle (0 to 360 degrees) of the swivel pad 46 relative to the spherical end 51A. The form of the spherical end 51A could be described as a spherical segment; and, any shape that accommodates the previously described rotating and tilting functionality could be utilized in its place.

The check valve assembly 34A is mounted to a bottom 53A of the piston 32A and includes a ball 36A, spring 38A, and cap 40A. The cap 40A can be mounted to the piston 32A via a press-fit or any other suitable method. The spring 38A seats against the cap 40A and forcibly engages the ball 36A with a pre-load force that biases the ball 36A to a closed position against a ball port 59A. Movement of the ball 36A of the check valve assembly 34A controls a flow of hydraulic fluid within the HLA assembly 30A. The HLA assembly 30A provides for a lash-free and maintenance-free valve train system facilitated by the piston 32A that can move to any necessary effective length in order to accommodate manufacturing tolerances along with thermal and wear effects on the valve train. FIG. 7A shows a first hydraulic position of the HLA assembly 30A, representative of an "as manufactured" height defined by a distance H1. After installation within an IC engine 96, the HLA assembly 30A accommodates the sizes of the valve train by compressing to a second HLA height H2, representing an "installed height."

The HLA assembly 30A forms multiple fluid pathways and fluid chambers which will now be described with reference to FIGS. 6A, 7A-7B, and 12A-12B. The socket plunger 24A and a bore 58A of the piston 32A form a first fluid chamber C1; the bottom 53A of the piston 32A and the bore 50A of the outer casing 44A form a second fluid chamber C2; and the socket plunger 24A, piston 32A and the longitudinal bore 27A of the outer housing 26A form a third fluid chamber C3. During a valve lift event in which the cam lobe 12 moves the hydraulic tappet 20A within the engine bore 98, the HLA assembly 30A is subjected to valve train forces that cause the piston 32A to move downward relative to the outer casing 44A. This occurs due to a compression of hydraulic fluid in the second fluid chamber C2, forcing the hydraulic fluid to escape through a controlled radial clearance between the piston 32A and the bore 50A of the outer casing 44A.

The check valve assembly 34A fluidly connects the first fluid chamber C1 to the second fluid chamber C2 via the ball port 59A. Hydraulic fluid flow from the first fluid chamber C1 to the second fluid chamber C2 occurs when a hydraulic fluid pressure force acting on the ball 36A via the first fluid chamber C1 is greater than a sum of: i) the hydraulic fluid pressure force acting on the ball 36A via the second fluid chamber C2; and, ii) the spring pre-load force acting on an underside of the ball via the spring 38A. Such hydraulic fluid flow typically occurs on base circle 13 of the camshaft 10 when the return spring 42A applies an upward force to the piston 32A to move it to a position that yields a zero lash condition for the valve train after the valve event has been completed.

Within the hydraulic tappet 20A, a first hydraulic fluid pathway P1 extends: i) from one of the radial ports 56 of the outer housing 26A that interfaces with the fluid gallery 89 that is fluidly connected to a hydraulic fluid pressure source 88 of the IC engine 96; ii) through an annulus 57 that connects the radial ports 56 of the outer housing 26A; iii) through the reduced diameter portion 54A of the outer casing; iv) through the third fluid chamber C3; and, v) to the first fluid chamber C1 via a cutout 55 formed on the lower end 35A of the socket plunger 24A. Hydraulic fluid then flows from the first fluid chamber C1 to the second fluid chamber C2 via the check valve assembly 34A, as previously described.

Within the hydraulic tappet 20A, a second hydraulic fluid pathway P2 extends: i) from one of the radial ports 56 of the outer housing 26A that interfaces with the fluid gallery 89 that is fluidly connected to the hydraulic fluid pressure source 88 of the IC engine 96; ii) through an annulus 57 that connects the radial ports 56 of the outer housing 26A; iii) through the reduced diameter portion 54A of the outer casing; iv) through the third fluid chamber C3; and, iv) through a first axial passage 60, a second radial passage 61, and a third axial passage 62 arranged in the socket plunger 24A to reach the receiving land 25A. The second hydraulic fluid pathway P2 can serve to lubricate the interface between the pushrod 80 and socket plunger 24A and, via a passageway (not shown) formed in the pushrod 80, provide lubrication to an interface between the pushrod 80 and rocker arm 90, a rocker arm bearing, and a rocker arm valve pallet.

The diametrical fit of any portion of the HLA assembly 30A within the longitudinal bore 27A of the outer housing 26A can be a slip fit, a transition fit, or a press-fit.

Figure 5:
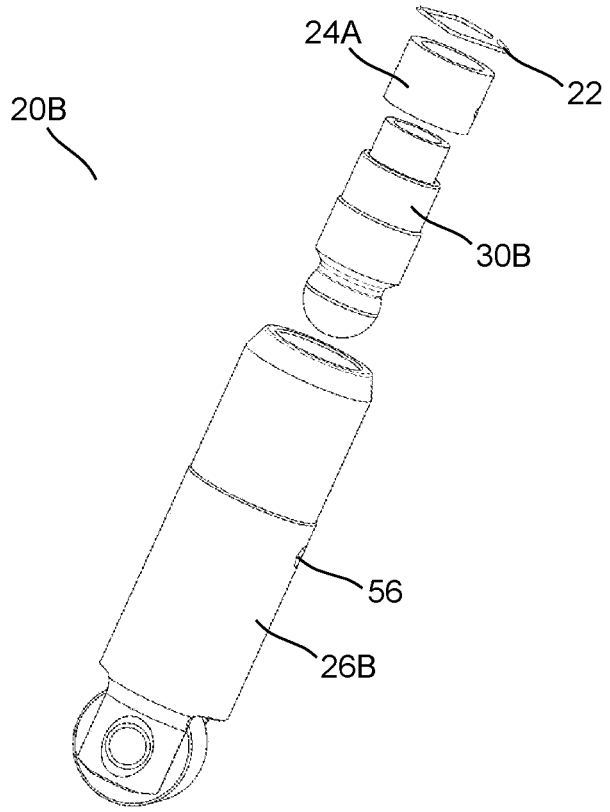
FIG. 5 shows an exploded perspective view of an example embodiment of a hydraulic tappet that includes an example embodiment of an HLA assembly.
Figure 6B:
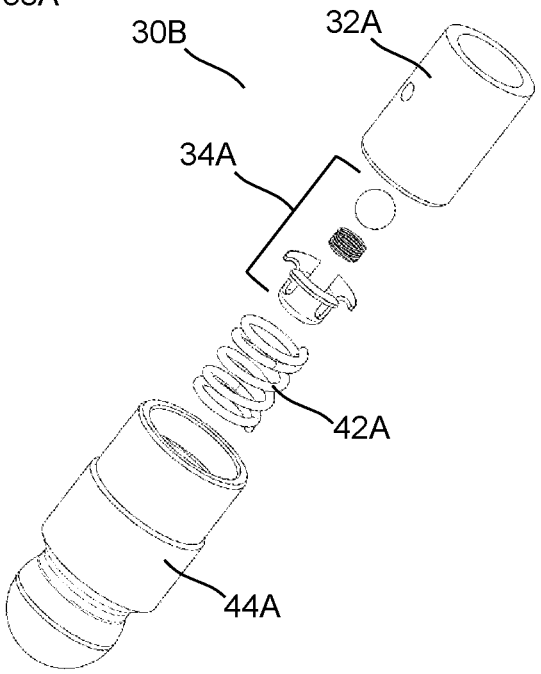
FIG. 6B shows an exploded perspective view of the HLA assembly of FIG. 5.
Figure 8:
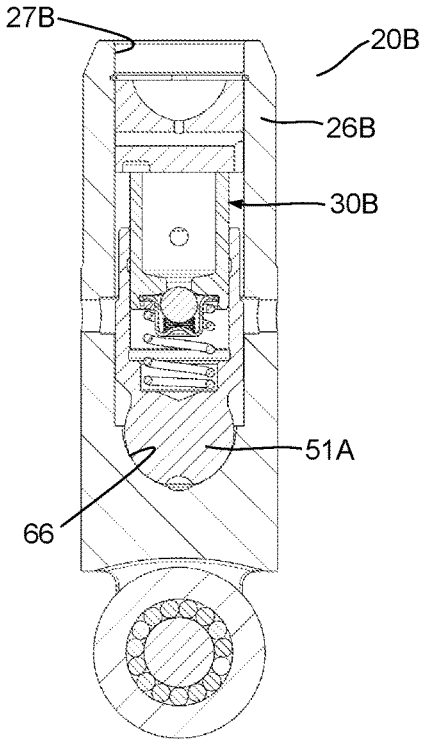
FIG. 8 shows a cross-sectional view of the hydraulic tappet of FIG. 5.

FIG. 5 shows an exploded perspective view of an example embodiment of a hydraulic tappet 20B. FIG. 6B shows an exploded perspective view of an example embodiment of an HLA assembly 30B used in the hydraulic tappet 20B of FIG. 5. FIG. 8 is a cross-sectional view of the hydraulic tappet 20B. The following discussion should be read in light of FIGS. 5, 6B and 8. The HLA assembly 30B is equivalent to the previously described HLA assembly 30A, but without the swivel pad 46. Therefore, the previous discussion regarding the formation of fluid chambers C1-C3 and the hydraulic function of HLA assembly 30A also applies to HLA assembly 30B. Given the absence of the swivel pad 46, the outer housing 26B includes a longitudinal bore 27B with a concave socket reception landing 66. The socket reception landing 66 receives the spherical end 51A of the outer casing 44A and can be formed as a concave gothic arch for optimized contact.

Figure 6C:
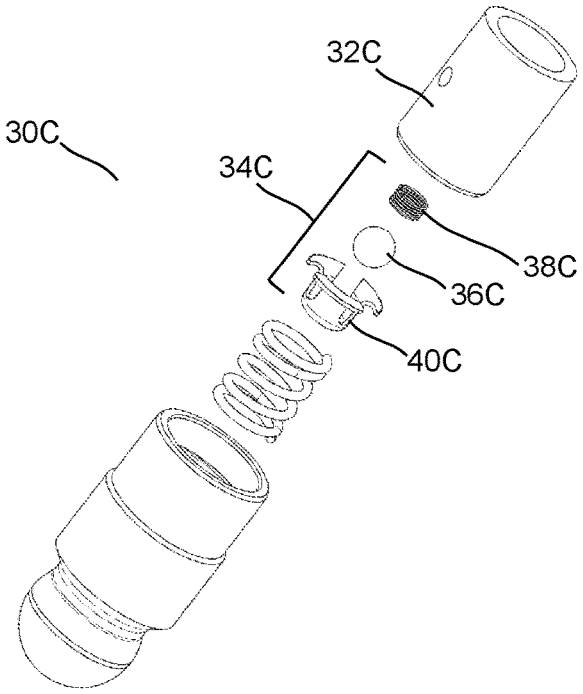
FIG. 6C shows an exploded perspective view of an example embodiment of an HLA assembly.
Figure 9:
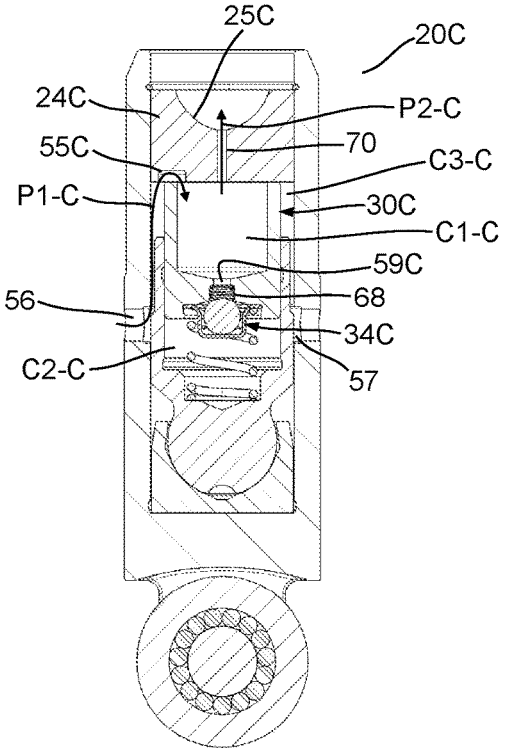
FIG. 9 shows a cross-sectional view of an example embodiment of a hydraulic tappet.
Figure 11A:
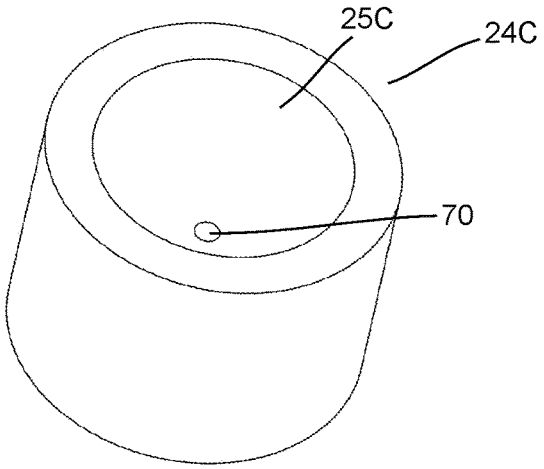
FIGS. 11A and 11B show perspective views of an example embodiment of a socket plunger.
Figure 11B:
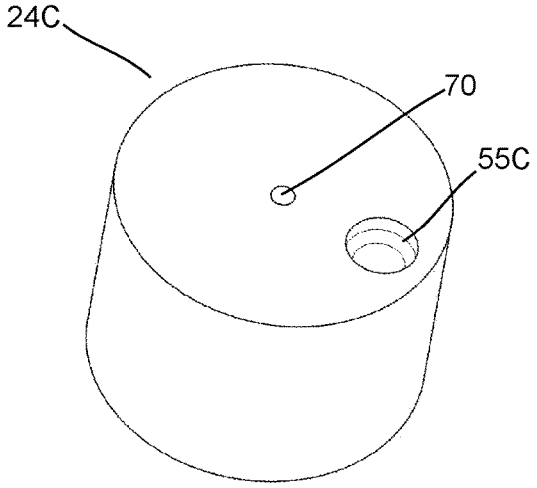

FIG. 6C shows an exploded perspective view of an example embodiment of an HLA assembly 30C. FIG. 9 shows a cross-sectional view of an example embodiment of a hydraulic tappet 20C that includes the HLA assembly 30C. FIGS. 11A and 11B show perspective views of an example embodiment of a socket plunger 24C. The following discussion should be read in light of FIGS. 6C, 9, and 11A-11B. The hydraulic tappet 20C differs from the previously described hydraulic tappet 20A in that it utilizes HLA assembly 30C and socket plunger 24C.

HLA assembly 30C includes an alternative check valve assembly 34C which is biased to an open position instead of a closed position like that of the check valve assembly 34A of the previously described HLA assemblies 30A, 30B. Check valve assembly 34C includes a ball 36C, a spring 38C, and a cap 40C. The cap 40C can be mounted to an underside of a piston 32C via a press-fit or any other suitable method. The spring 38C is disposed within a spring well 68 formed within a ball port 59C located on the bottom of the piston 32C. The spring 38C forcibly engages the ball 36C with a pre-load force that biases the ball to an open position against the cap 40C. The check valve assembly 34C can provide functional benefits over the previously described "biased-closed" check valve assembly 34A when utilized within an environment that yields functional disturbances. Examples of functional disturbances can include high base circle runout of the camshaft and/or a high tendency for pump-up to occur due to valve train separation at high engine speeds.

HLA assembly 30C forms first fluid chamber C1-C, second fluid chamber C2-C, and third fluid chamber C3-C, the location of which remain the same as the previously described fluid chambers C1, C2, C3 for HLA assembly 30A. The ball 36C closes against the ball port 59C when a downward descent of the piston 32C, induced by a ramp on a cam lobe, creates a pressure distribution on the ball 36C within the third fluid chamber C3-C that yields a force that overcomes the summation of a pre-load force of the spring 38C and a force applied to the ball via the pressure of the first fluid chamber C1-C.

Within the hydraulic tappet 20C, a first hydraulic pathway P1-C, similar to the previously described first hydraulic pathway P1 of hydraulic tappet 20A, extends: i) from the radial port 56 and annulus 57; ii) through the third fluid chamber C3-C; and, iii) to the first fluid chamber C1-C via a cutout 55C formed on the socket plunger 24C.

Within the hydraulic tappet 20C, a second hydraulic fluid pathway P2-C extends from the first fluid chamber C1-C to the receiving land 25C via an axial gallery 70 arranged within the socket plunger 24C so as to provide lubrication to an interface with the pushrod 80 and also potentially to an interface between the pushrod 80 and rocker arm 90.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A tappet configured for an internal combustion engine, the tappet comprising:

an outer housing configured to be longitudinally displaced by a camshaft;

a blind first longitudinal bore;

a socket plunger disposed within the first longitudinal bore;

a hydraulic lash adjuster assembly disposed within the first longitudinal bore and engaged with the socket plunger, the hydraulic lash adjuster assembly having:

an outer casing with a spherical first end;

a piston disposed at least partially within a second end of the outer casing, the piston and socket plunger defining a first fluid chamber, and the piston and outer casing defining a second fluid chamber; and, a check valve assembly arranged to fluidly connect the first fluid chamber to the second fluid chamber; and, a swivel pad including a first side configured to engage the spherical first end so as to form a spherical joint, and a second side configured to engage a bottom end of the list longitudinal bore.

2. The tappet of claim 1, wherein the outer housing includes a roller configured to directly engage the camshaft.

3. The tappet of claim 1, wherein the check valve assembly is biased to a closed position.

4. The tappet of claim 1, wherein the check valve assembly is biased to an open position.

5. The tappet of claim 1, wherein the outer housing is displaced a first height by the camshaft, the first height equal to a cam lift of the camshaft.

6. The tappet of claim 1, wherein the outer casing, piston, and socket plunger define a third fluid chamber that is fluidly connected to the first fluid chamber.

7. The tappet of claim 6, wherein the outer housing comprises at least one radial port configured to connect a hydraulic fluid pressure source to the third fluid chamber.

8. The tappet of claim 1, wherein the bottom end of the first longitudinal bore is formed in the outer housing.

9. The tappet of claim 1, wherein the socket plunger fluidly connects the first fluid chamber to a concave landing arranged on the socket plunger.

10. The tappet of claim 9, wherein the socket plunger includes an axially extending passage and a transverse passage.

11. A tappet configured for an internal combustion engine, the tappet comprising:

an outer housing configured to be longitudinally displaced by a camshaft, the outer housing having a first longitudinal bore;

a socket plunger disposed within the first longitudinal bore;

a hydraulic lash adjuster assembly disposed within the first longitudinal bore and engaged with the socket plunger, the hydraulic lash adjuster assembly having:

an outer casing disposed within the first longitudinal bore, the outer casing including a spherical first end;

a piston configured to adjust a lash in a valve train system, the piston extending from a second end of the outer casing, such that:

the piston and socket plunger define a first fluid chamber; and, the piston and outer casing define a second fluid chamber;

a check valve assembly arranged to fluidly connect the first fluid chamber to the second fluid chamber; and, a swivel pad including a first side configured to engage the spherical first end so as to form a spherical joint, and a second side configured to engage a closed bottom end of the first longitudinal bore.

12. The tappet of claim 11, wherein the socket plunger is configured to engage a pushrod so as to actuate a rocker arm of the internal combustion engine.

13. The tappet of claim 11, wherein the closed bottom end of the first longitudinal bore is formed in the outer housing.

14. A tappet for an internal combustion engine, the tappet comprising:

a central axis;

an outer housing configured to be longitudinally displaced by a camshaft, the outer housing having a first longitudinal bore;

a socket plunger disposed within the first longitudinal bore; and, a hydraulic lash adjuster assembly disposed within the first longitudinal bore and engaged with the socket plunger, a first portion of the hydraulic lash adjuster assembly configured to tilt and rotate relative to a remaining portion of the hydraulic lash adjuster assembly;

wherein the first portion is a swivel pad including a concave reception landing configured to engage a spherical end of the remaining portion; and, wherein the swivel pad is further configured to engage a closed bottom end of the first longitudinal bore.

15. The tappet of claim 14, wherein the first portion is configured to tilt to an angle of at least three degrees relative to the remaining portion.

16. The tappet of claim 14, wherein the outer housing includes a roller configured to directly engage the camshaft.

17. The tappet of claim 14, wherein the socket plunger is configured to engage a pushrod.

18. The tappet of claim 14, wherein the closed bottom end of the first longitudinal bore is formed in the outer housing.

* * * * *